US006478151B1

(12) United States Patent
Schmidt et al.

(10) Patent No.: US 6,478,151 B1
(45) Date of Patent: Nov. 12, 2002

(54) REMOVABLE AND REPOSITIONABLE POCKET ASSEMBLY FOR GOLF BAGS

(75) Inventors: Gregory J. Schmidt, Glendale, AZ (US); Gregory M. Suggs, Phoenix, AZ (US)

(73) Assignee: Karsten Manfacturing Corporation, Phoenix, AZ (US)

( * ) Notice: Subject to any disclaimer, the term of this patent is extended or adjusted under 35 U.S.C. 154(b) by 0 days.

(21) Appl. No.: 09/948,450

(22) Filed: Sep. 7, 2001

(51) Int. Cl.[7] ..... A63B 55/00

(52) U.S. Cl. ..... 206/315.5; 206/315.3; 190/108; 224/274

(58) Field of Search ..... 206/315.2, 315.3, 206/315.5, 315.6; 224/274; 190/108

(56) References Cited

U.S. PATENT DOCUMENTS

| | | | | | |
|---|---|---|---|---|---|
| 2,799,315 | A | * | 7/1957 | Strasburg | 206/315.3 |
| 3,164,185 | A | * | 1/1965 | Ingoldt | 206/315.5 |
| 3,373,911 | A | * | 3/1968 | Kebelbeck | 206/315.2 |
| 4,142,563 | A | * | 3/1979 | Ackerfeldt et al. | 206/315.5 |
| 4,206,835 | A | * | 6/1980 | Shapiro | 190/108 |
| 4,350,194 | A | * | 9/1982 | Brown | 206/315.5 |
| 4,420,068 | A | * | 12/1983 | Gerch | 190/108 X |
| 4,424,841 | A | * | 1/1984 | Smith | 190/108 X |
| 4,459,827 | A | * | 7/1984 | Rhodes | 224/274 |
| 4,487,347 | A | * | 12/1984 | Zegar | 206/315.5 X |
| 4,522,300 | A | * | 6/1985 | Hamblet | 206/315.4 |
| 4,744,446 | A | * | 5/1988 | Arney | 190/108 |
| 4,869,365 | A | | 9/1989 | Perdue et al. | |
| 4,905,827 | A | | 3/1990 | Kim | |
| 4,974,709 | A | * | 12/1990 | Furlow et al. | 190/108 X |
| 5,031,766 | A | * | 7/1991 | Cohen | 190/108 X |
| 5,038,984 | A | * | 8/1991 | Izzo | 224/209 |
| 5,096,059 | A | * | 3/1992 | Henderson | 206/315.5 |
| 5,105,958 | A | * | 4/1992 | Patton | 224/274 X |
| 5,176,253 | A | | 1/1993 | Perrin et al. | |
| 5,277,328 | A | * | 1/1994 | Tocco | 206/315.3 X |
| 5,314,063 | A | | 5/1994 | Lee et al. | |
| 5,341,928 | A | | 8/1994 | Jones et al. | |
| 5,465,839 | A | * | 11/1995 | Gretz | 206/315.3 |
| 5,590,773 | A | * | 1/1997 | Robinett | 206/315.1 |
| 5,860,519 | A | * | 1/1999 | Meyer et al. | 206/315.3 |
| 5,975,390 | A | * | 11/1999 | Saroli | 224/274 |
| 6,161,692 | A | * | 12/2000 | Lizarraga | 206/315.3 |
| 6,164,425 | A | * | 12/2000 | Latshaw | 206/315.3 X |
| 6,283,260 | B1 | * | 9/2001 | Yamada, Sr. | 190/108 X |
| 6,394,325 | B1 | * | 5/2002 | Taylor | 224/274 |

FOREIGN PATENT DOCUMENTS

| | | | | |
|---|---|---|---|---|
| DE | 3211413 | * | 12/1983 | 190/108 |
| DE | 3934760 | * | 4/1991 | 190/108 |
| GB | 347220 | * | 4/1931 | 190/102 |
| GB | 2257028 | * | 1/1993 | 190/102 |

* cited by examiner

*Primary Examiner*—Sue A. Weaver
(74) *Attorney, Agent, or Firm*—Darrell F. Marquette

(57) ABSTRACT

A pocket assembly is removably attached to a generally tubular body of a golf bag. The pocket assembly includes a receptacle with a pair of pockets for holding golf accessories. An upstanding rib is formed on the body, and spring clips are provided on the receptacle for gripping engagement with the rib to position the pocket assembly at a selected location on the body. When the pocket assembly is attached to the body, the receptacle straddles the rib and the pockets are disposed on opposite sides of the rib. The spring clips may be disengaged from the rib so that the pocket assembly may be removed from the body and relocated to another selected location on the body. Straps attached to the spring clips are wrapped around the body, and hook and loop fasteners are used to fasten the straps together.

19 Claims, 6 Drawing Sheets

REMOVABLE AND REPOSITIONABLE POCKET ASSEMBLY FOR GOLF BAGS

BACKGROUND OF THE INVENTION

This invention relates generally to golf equipment and, in particular, to a removable and repositionable pocket assembly for golf bags.

U.S. Pat. No. 5,176,253 to J. B. Perrin et al discloses a golf bag with a pouch that may be removed from the golf bag and worn about a person's waist. The pouch is attached to a fixed location on the golf bag by a zipper, and a pair of straps secured to the pouch are connected together by a buckle. One of the straps has an adjustment device for adjusting its length.

U.S. Pat. No. 5,341,928 to A. L. Jones et al discloses a pocket that can be attached to and detached from a golf bag. The pocket is connected to the golf bag by hooks which are joined to fabric loops provided at opposite ends of the pocket. One of the hooks is joined to the pocket by a resilient cord. The pocket has a zippered opening and is constructed, when empty, to lie flat against the golf bag.

U.S. Pat. No. 4,869,365 to K. J. Perdue et al discloses an accessory that is similar to the pocket disclosed in the Jones et al patent. In the accessory disclosed by K. J. Perdue et al, a plurality of pockets are mounted on a panel which is removably attached to a golf bag by a pair of hooks. Elastic cords connect the hooks to the panel.

SUMMARY OF THE INVENTION

The present invention provides a pocket assembly for a golf bag wherein the golf bag includes a generally tubular body having a closed bottom end and an open top end. An upstanding rib on the body extends from proximate the closed bottom end toward the open top end thereof. The pocket assembly comprises a receptacle, and clip means such as a spring clip on the receptacle that is engageable with the rib for positioning the pocket assembly at a selected location on the body. The clip means is disengageable from the rib so that the pocket assembly may be removed from the body and repositioned at another selected location on the body. The receptacle straddles the rib and includes a pair of pockets for holding golf accessories. The pockets are disposed on opposite sides of the rib when the pocket assembly is positioned at any selected location on the body. The clip means may include a pair of spring clips on an underside of the receptacle. The spring clips are spaced apart along a longitudinal axis of the receptacle, and a pair of straps are attached to each of the spring clips so as to extend in opposite directions from each of the spring clips. Fastener means such as hook and loop fasteners are provided on the pair of straps for fastening the straps to each other when they are wrapped around the body. Each of the spring clips may include a pair of arm portions to which the straps are attached.

DESCRIPTION OF THE PREFERRED EMBODIMENTS

Figure 1:
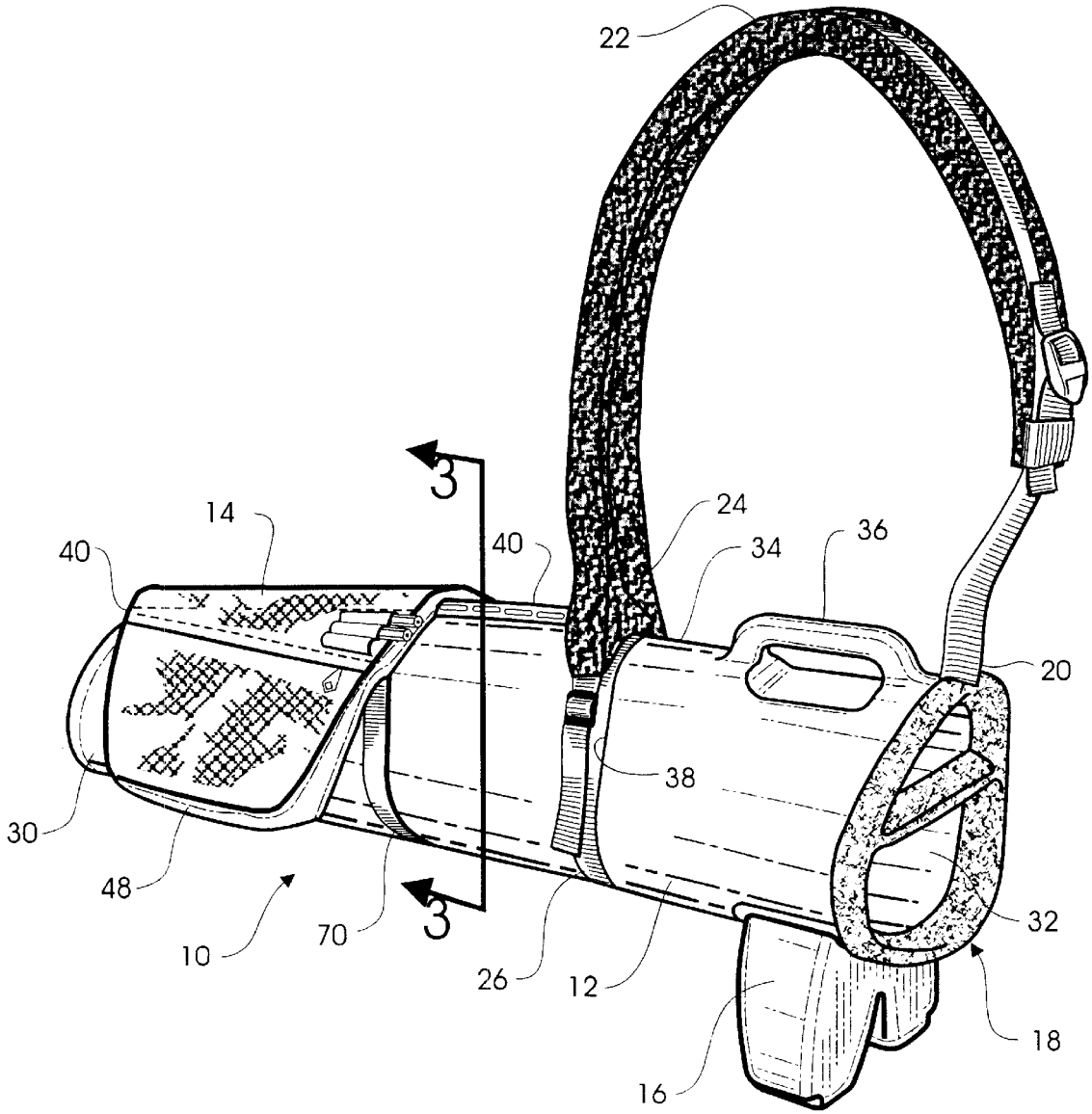
FIG. 1 is a perspective view of a golf bag incorporating a removable and repositionable pocket assembly in accordance with one embodiment of the present invention.

Referring to the drawings, FIG. 1 shows a golf bag which is indicated generally by the reference numeral 10. The golf bag 10 includes a generally tubular body 12, a pocket assembly 14 according to one embodiment of the present invention for carrying accessories used in playing golf such as golf balls, tees and the like. The pocket assembly 14 is removably attached to the body 12 as described below. Also included on the golf bag 10 is a stand 16 for propping up the body 12 so that, whenever the golf bag 10 is resting on the ground, the heads of the golf clubs (not shown) will not contact the ground. The body 12 has a protective collar 18 attached thereto with the collar 18 having an upper end 20 of a shoulder strap 22 coupled thereto. A lower end 24 of the shoulder strap 22 is coupled to the body 12 by an attachment strap 26.

The body 12 is an elongated unitary structure having a closed bottom end 30 and an open top end 32. The body 12 preferably has a generally ovoid cross sectional shape so that a relatively small radius portion of the ovoid shape provides a ridge 34 which extends generally longitudinally of the body 12. A handle 36 is integrally formed on and along one side of the body 12 so as to extend therefrom in a plane that is substantially perpendicular to the longitudinal axis of the body 12. The handle 36 is positioned on the ridge 34 proximate the open top end 32 of the body 12. An annular groove 38 is formed in the body 12 for receiving the attachment strap 26 of the shoulder strap 22 to prevent longitudinal movement of the shoulder strap lower end 24 when the shoulder strap 22 is coupled to the body 12 in the manner shown in FIG. 1.

A connector device is provided on the lower end 24 of the shoulder strap 22 and on the body 12 so that the shoulder strap 22 will extend normally from the body 12 in substantially the same plane as the handle 36. When the golf bag 10 is resting on the ground in the propped up position as shown in FIG. 1, the shoulder strap 22 will be disposed in an upwardly extending position so that, without bending over, a golfer may pick up the golf bag 10 from the propped up position of FIG. 1.

Figure 4:
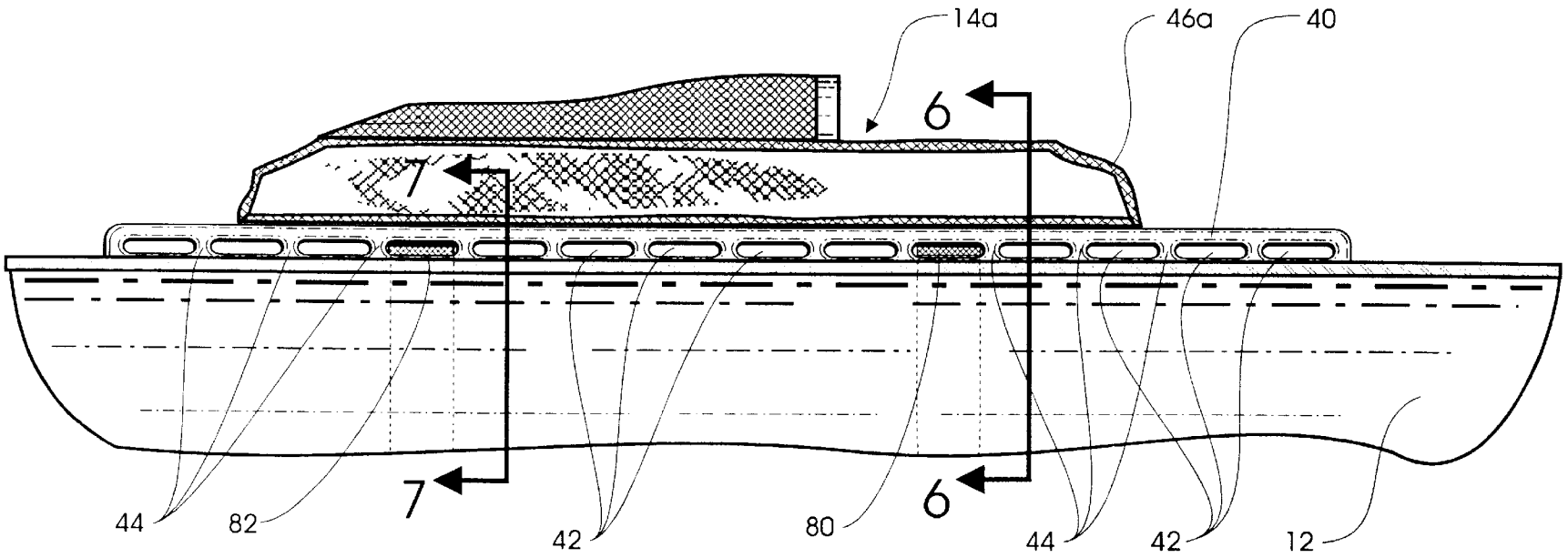
FIG. 4 is an enlarged sectional view of a golf bag incorporating a removable and repositionable pocket assembly according to another embodiment of the present invention.
Figure 5:
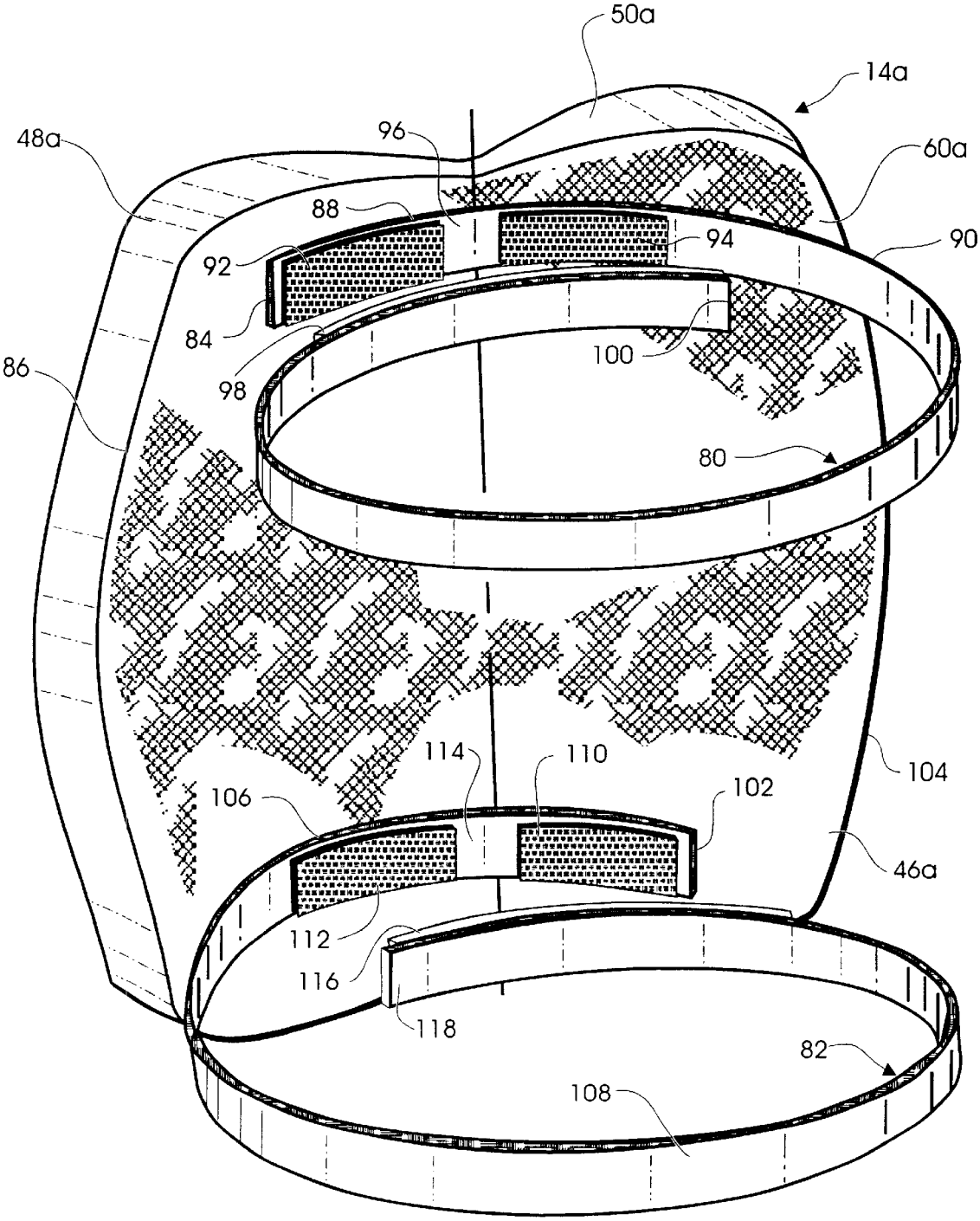
FIG. 5 is an enlarged perspective view of the pocket assembly shown in FIG. 4.

The body 12 also includes an upstanding rib 40 which extends from proximate the closed bottom end 30 toward the open top end 32. The rib 40 also extends from the body 12 in the same direction as the handle 36 and the shoulder strap 22, and, as seen best in FIG. 4, is provided with a plurality of slots 42 therein separated from each other by partitions 44. The rib 40 provides rigidity to the body 12 and functions to removably attach the pocket assembly 14 to the body 12.

Figure 2:
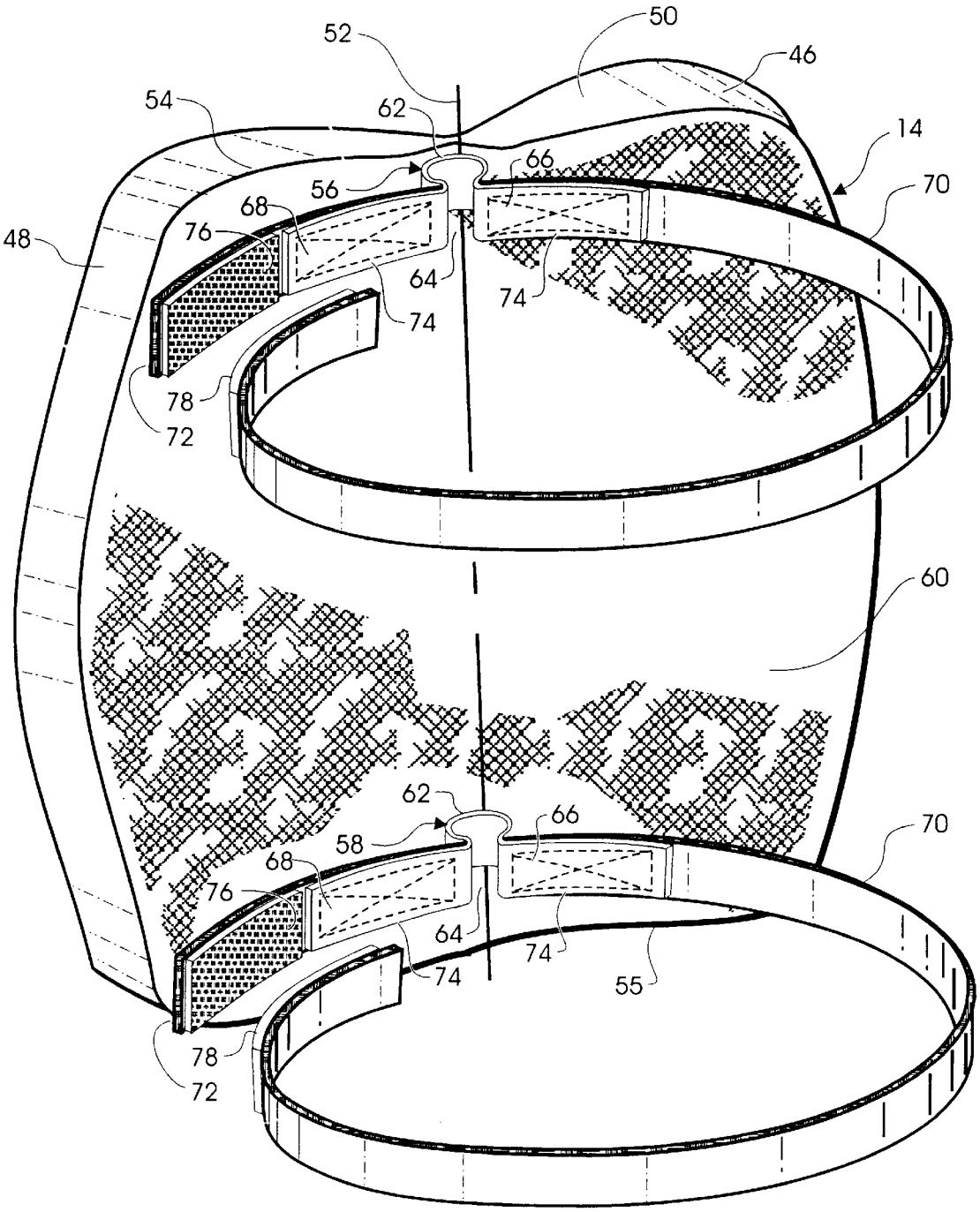
FIG. 2 is an enlarged perspective view of the pocket assembly shown in FIG. 1.
Figure 3:
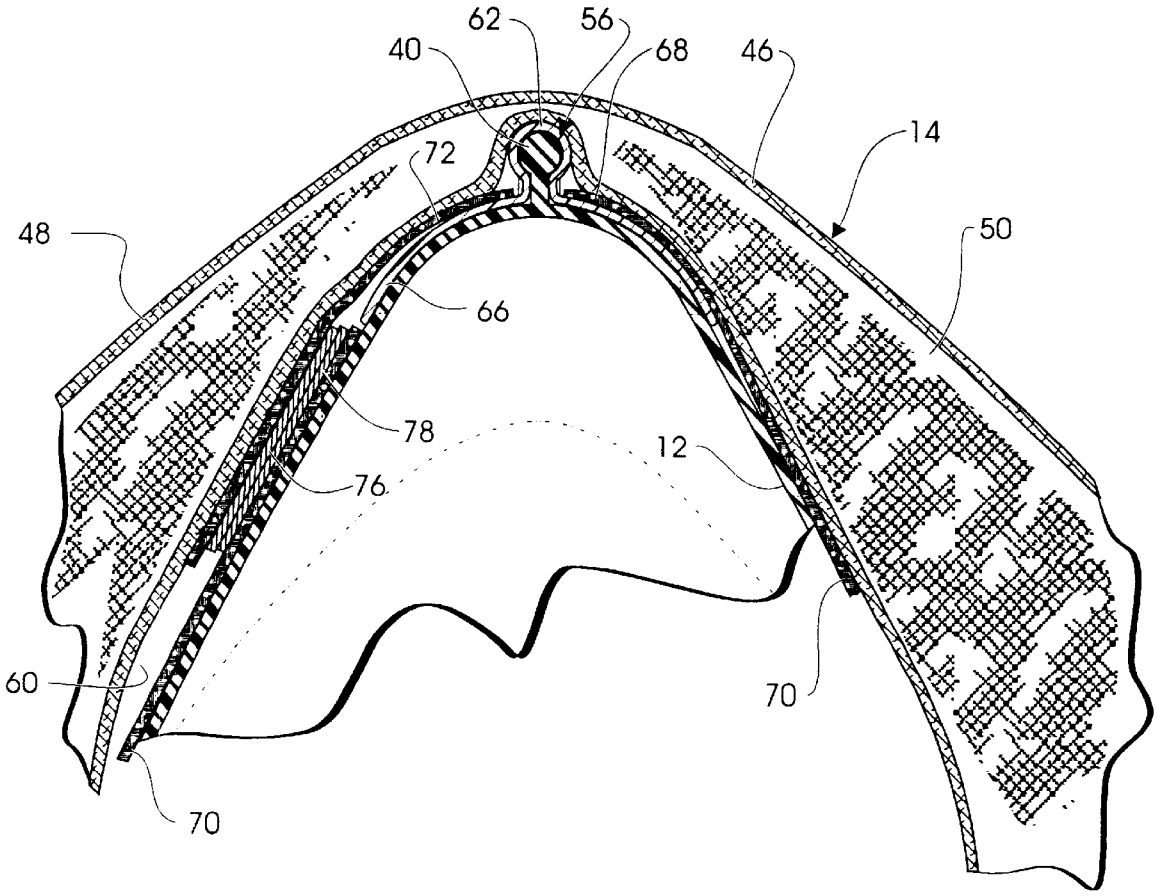
FIG. 3 is an enlarged sectional view taken along the lines 3—3 in FIG. 1.

Referring now to FIGS. 2 and 3, the pocket assembly 14 includes a receptacle 46 which straddles the rib 40 and has two pockets 48 and 50 for holding golf accessories. The pockets 48, 50 are disposed on opposite sides of the rib 40 and on opposite sides of a longitudinal axis 52 which extends from a top edge 54 to a bottom edge 55 of the receptacle 46. Clip means such as a pair of spring clips 56 and 58, formed of resilient material preferably polyethylene, are attached to the underside 60 of the receptacle 46 in spaced relationship with respect to each other along the longitudinal axis 52. Each of the spring clips 56, 58 has a clamp portion 62 shaped as a major arc of a circle. That is, the clamp portions 62 of the spring clips 56, 58 are circular and are greater than a semicircle with the ends of the major arc defining gaps 64 in the springs clips 56, 58. The ends of the clamp portions 62 which define the gaps 64 each have integrally formed arcuate arm portions 66 and 68 extending in opposite directions therefrom. The arm portions 66 each have an elongated strap 70 extending therefrom, and the other arm portions 68 each have a short strap 72 extending therefrom. The straps 70 and 72 are attached to their respective arm portions 66 and 68, and the arm portions 66, 68 are attached to the underside 60 of the receptacle 46 by sewing as indicated at 74 in FIG. 2.

FIG. 3 shows the spring clip 56 and the straps 70, 72 employed to removably attach the pocket assembly 14 to the body 12. Since the spring clips 56, 58 and their associated straps 70, 72 are identical assemblies, it will be understood that the following description will apply to both assemblies. The clamp portion 62 of the spring clip 56 is installed on the rib 40 by pushing it onto the rib 40. Due to the resilience of the spring clip 56, the clamp portion 62 of the spring clip 56 will be forced open as it moves down onto the rib 40 and then will snap into gripping engagement therewith when the spring clip 56 is pushed fully onto the rib 40. The elongated strap 70 is wrapped around the body 12 and is placed in contiguous engagement with the short strap 72. Hook and loop fastener strips 76, 78 provided on the straps 70, 72 are preferably used to fasten the straps 70, 72 to each other. It will be appreciated that alternatively buckles (not shown) may be used to fasten the straps 70, 72 together. If desired, the pocket assembly 14 may be repositioned on the body 12 by disengaging the spring clips 56, 58 from the rib 40 and relocating them along the length of the rib 40.

FIGS. 4, 5, 6 and 7 show a pocket assembly 14*a* according to another embodiment of the present invention. The pocket assembly 14*a* is provided with two straps 80 and 82 sewn to the underside 60*a* of a receptacle 46*a*. The strap 80 has an outer end edge 84 thereof positioned adjacent a side edge 86 of the receptacle 46*a* and a first portion 88 thereof which extends transversely across the underside 60*a*. A second portion 90 of the strap 80 extends laterally from the receptacle 46*a* and is wrapped around the body 12 as described below. A hook and loop fastener is provided on the strap 80 and includes a first fastener strip 92 which is attached to the first portion 88 of the strap 80 proximate the outer end edge 84 thereof and a second fastener strip 94 which is attached to the first portion 88 of the strap 80 along the length thereof with a space 96 being provided between the two fastener strips 92, 94. The hook and loop fastener also includes a third fastener strip 98 which is attached to the second portion 90 of the strap 80 proximate an end edge 100 thereof. The third fastener strip 98 is attached to one side of the strap 80, and the fastener strips 92 and 94 are attached to the other side of strap 80. The fastener third strip 98 is long enough to grippingly engage both the first and second fastener strips 92 and 94 when the strap 80 is wrapped around the body 12.

The other strap 82 has an outer end edge 102 thereof positioned adjacent a side edge 104 the receptacle 46*a* and a first portion 106 thereof extends transversely across the receptacle underside 60*a*. A second portion 108 of the strap 82 extends laterally from the receptacle 46*a* and is wrapped around the body 12 in a direction which is opposite to that of the strap portion 90. A hook and loop fastener is provided on the strap 82 and includes a first fastener strip 110 which is attached to the first portion 106 of the strap 82 proximate the end edge 102 thereof and a second fastener strip 112 which is attached to the first portion 106 of the strap 82 along the length thereof with a space 114 being provided between the two fastener strips 110, 112. The hook and loop fastener also includes a third fastener strip 116 which is attached to the second portion 108 of the strap 82 proximate an end edge 118 thereof. The third fastener strip 116 is attached to one side of the strap 82, and the fastener strips 110 and 112 are attached to the other side of the strap 82. The third fastener strip 116 is long enough to grippingly engage both the first and second fastener strips 110 and 112 when the strap 82 is wrapped around the body 12.

Figure 6:
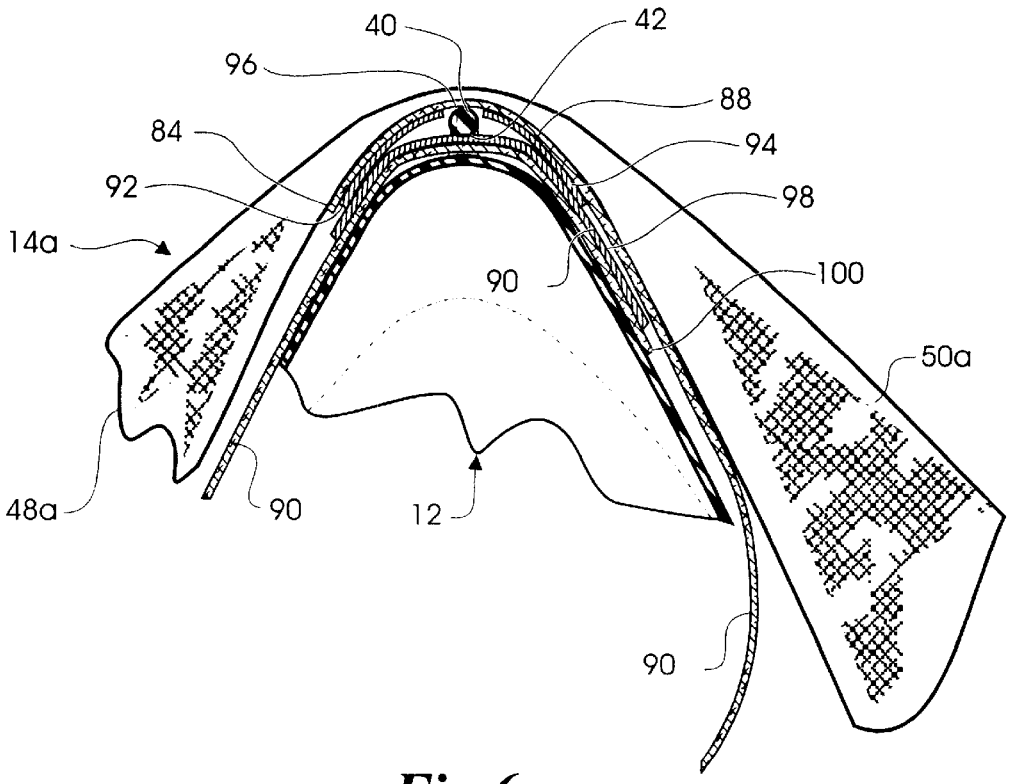
FIG. 6 is a sectional view taken along the lines 6—6 in FIG. 4.
Figure 7:
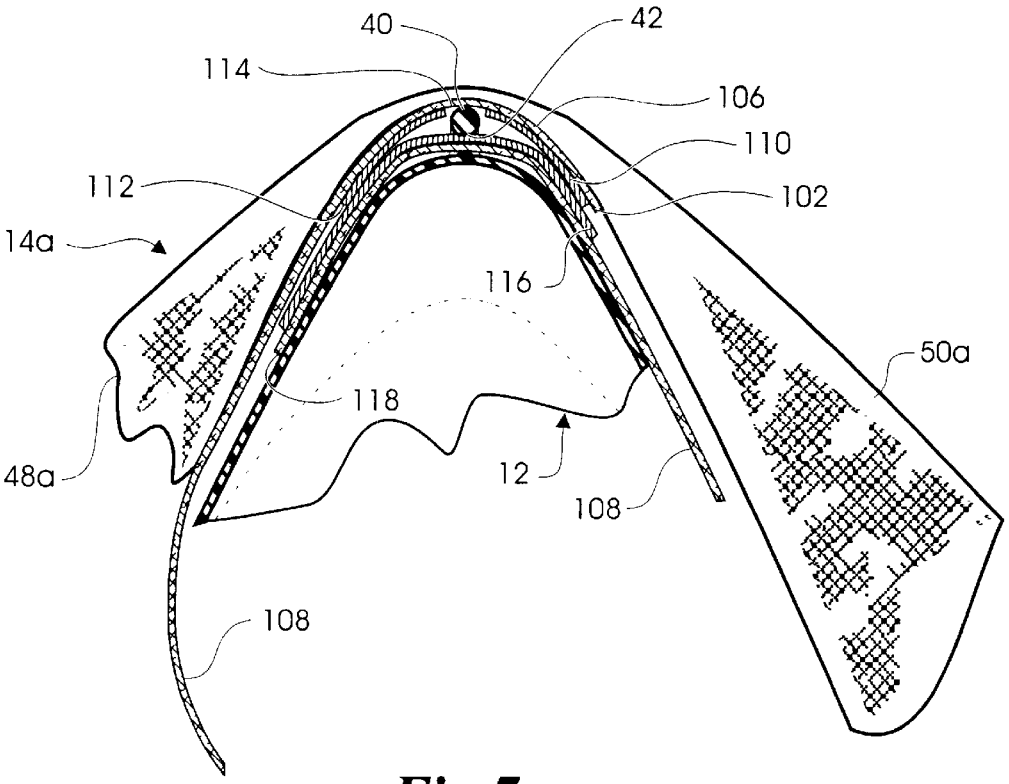
FIG. 7 is a sectional view taken along the lines 7—7 in FIG. 4.

The straps 80 and 82 are passed through a spaced apart pair of the slots 42 in the upstanding rib 40 as seen in FIG. 4. FIGS. 6 and 7 show the straps 80 and 82 mounted on the body 12. In FIG. 6, the outer end edge 84 of the strap 80 is shown on the left side of the body 12, and the first portion 88 of the strap 80 passes over the top of the upstanding rib 40 and down the right side of the body 12. The second portion 90 of the strap 80 loops around the body 12 and is passed through one of the slots 42 of the rib 40. When in this position, the second portion 90 of the strap 80 will be in a juxtaposed position relative to the first portion 88 thereof and the fastener strip 98 will be in gripping engagement with both of the fastener strips 92 and 94. The strap 82 is looped around the body 12 in a direction opposite to that of the strap 82. The outer end edge 102 of the strap 82 is on the right side of the body 12, as seen in FIG. 7, and the first portion 106 of the strap 82 passes over the top of the rib 40 and down the left side of the body 12. The second portion 108 of the strap 82 is looped around the body 12 and is passed through one of the slots 42 in the rib 40. When in this position, the second portion 108 of the strap 82 will be in a juxtaposed position relative to the first portion 106 thereof and the fastener strip 116 will be in gripping engagement with both of the fastener strips 110 and 112.

The inner end edges of the fastener strips 92 and 94 which face toward the space 96 provided on the strap 80 and the inner end edges of the fastener strips 110 and 112 which face toward the space 114 provided on the strap 82 act as stops and will move into engagement with the rib 40 to prevent rotation of the pocket assembly 14 about the body 12 which could occur as a result of uneven loading of the pockets 48*a* and 50*a*. With both of the straps 80 and 82 in place as described above, the pocket assembly 14*a* will be securely mounted on the body 12 and held against unwanted rotation about the body 12. It will be appreciated that the pocket assembly 14*a* may be repositioned on the body 12 by selecting a different pair of the slots 42 in the rib 40 through which the straps 80, 82 pass.

What is claimed is:

1. A pocket assembly for a golf bag wherein said golf bag includes a generally tubular body and an upstanding rib on said body, said pocket assembly comprising:

a receptacle having an underside;

a spring clip on the underside of said receptacle for gripping engagement with said upstanding rib;

said spring clip including a clamp portion shaped as a major arc of a circle with opposite ends of the major arc defining a gap therebetween, and a pair of arm portions extending in opposite directions from the opposite ends of the major arc;

a pair of straps attached to said spring clip and extending in opposite directions from said spring clip, said pair of straps being wrapped around said body in opposite directions; and fastener means on said pair of straps for fastening said pair of straps to each other when they are wrapped around said body.

2. The pocket assembly of claim 1, wherein said pair of straps are attached to the pair of arm portions of said spring clip.

3. The pocket assembly of claim 2, wherein both said pair of straps and said arm portions are attached to the underside of said receptacle.

4. The pocket assembly of claim 1, wherein said fastener means comprises a hook and loop fastener.

5. The pocket assembly of claim 1, wherein said receptacle straddles said rib and includes a pair of pockets for holding golf accessories, and wherein said pockets are disposed on opposite sides of said rib.

6. A pocket assembly for a golf bag wherein said golf bag includes a generally tubular body and an upstanding rib on said body extending generally longitudinally of said body, said pocket assembly comprising:

a receptacle having a longitudinal axis and an underside;

a pair of spring clips on the underside of said receptacle for gripping engagement with said upstanding rib, said spring clips being spaced apart along said longitudinal axis;

each of said spring clips including a clamp portion shaped as a major arc of a circle with opposite ends of the major arc defining a gap therebetween, and a pair of arm portions extending in opposite directions from the opposite ends of the major arc;

a pair of straps attached to each of said spring clips and extending in opposite directions from each of said spring clips and being wrapped around said body in opposite directions; and fastener means on said pairs of straps for fastening said pairs of straps to each other when they are wrapped around said body.

7. The pocket assembly of claim 6, wherein each of said pair of straps are attached to the pair of arm portions of each of said spring clips.

8. The pocket assembly of claim 7, wherein both said pair of straps and said pair of arm portions are attached to the underside of said receptacle.

9. The pocket assembly of claim 6, wherein said fastener means comprise hook and loop fasteners.

10. The pocket assembly of claim 6, wherein said receptacle straddles said rib and includes a pair of pockets for holding golf accessories, and wherein said pockets are disposed on opposite sides of said rib.

11. A pocket assembly for a golf bag wherein said golf bag includes a generally tubular body and an upstanding rib on said body extending generally longitudinally of said body, said rib having a pair of spaced apart slots formed therein, said pocket assembly comprising:

a receptacle having an underside;

a spaced apart pair of straps each having a first portion affixed to the underside of said receptacle and each having a second portion wrapped about said body and passing through one of the pair of slots, the second portion of each of said pair of straps being in a juxtaposed position relative to the first portion thereof; and a pair of hook and loop fasteners affixed to each of said pair of straps, each of said pair of hook and loop fasteners fastening together the juxtaposed first and second strap portions.

12. The pocket assembly of claim 11, wherein said upstanding rib is formed with a plurality of slots along its length.

13. The pocket assembly of claim 12, wherein said pair of straps are affixed to said receptacle so that the second portions thereof are wrapped about said body in opposite directions.

14. The pocket assembly of claim 13, wherein said pair of straps pass through selected pairs of the slots for removably attaching said pocket assembly to said body.

15. The pocket assembly of claim 11, wherein said receptacle straddles said rib and has a pair of pockets for holding golf accessories, and wherein said pockets are disposed on opposite sides of said rib.

16. The pocket assembly of claim 11, wherein each of said pair of said hook and loop fasteners comprises:

a first fastener strip affixed to the first portion of one of said pair of straps on one side of said upstanding rib;

a second fastener strip affixed to the first portion of one of said pair of straps on the other side of said upstanding rib; and a third fastener strip affixed to the second portion of one of said pair of straps in gripping engagement with said first and said second fastener strips thereof.

17. A pocket assembly for a golf bag wherein said golf bag includes a generally tubular body having a closed bottom end and an open top end, an upstanding rib on said body extending from proximate said closed bottom end toward said open top end, said pocket assembly comprising:

a receptacle;

a spring clip attached to an underside of said receptacle engageable with said rib for positioning said pocket assembly at a selected location on said body;

said spring clip being disengageable from said rib so that said pocket assembly may be removed from said body and repositioned at another selected location on said body;

said spring clip having a pair of arm portions; and a pair of straps attached to said pair of arm portions and extending in opposite directions from said spring clip, said pair of straps being wrapped around said body in opposite directions.

18. The pocket assembly of claim 17, further comprising fastener means on said pair of straps for fastening said pair of straps to each other when they are wrapped around said body.

19. The pocket assembly of claim 17, wherein said receptacle straddles said rib and includes a pair of pockets for holding golf accessories, and wherein said pockets are disposed on opposite sides of said rib when said pocket assembly is positioned at said selected location on said body.

* * * * *